United States Patent [19]

Dubreuil et al.

[11] Patent Number: 5,042,452

[45] Date of Patent: Aug. 27, 1991

[54] RADIATING TUBES SYSTEM FOR HEATING OVENS

[75] Inventors: Bernard Dubreuil; Gérard Jodet, Sucy En Brie, both of France

[73] Assignee: Stein Heurtey, Ris Orangis, France

[21] Appl. No.: 481,059

[22] Filed: Feb. 16, 1990

[30] Foreign Application Priority Data

Feb. 17, 1989 [FR] France ..... 89-02117

[51] Int. Cl.[5] ..... F24C 3/00

[52] U.S. Cl. ..... 126/91 A; 165/67; 165/162; 122/510; 432/209

[58] Field of Search ..... 126/92 B, 91 A; 165/168, 162, 82, 77, 76, 69; 432/202, 209, 251, 266; 122/510

[56] References Cited

U.S. PATENT DOCUMENTS

| | | | |
|---|---|---|---|
| 2,204,144 | 10/1935 | Moore et al. . | |
| 2,652,037 | 9/1953 | Lewis et al. . | |
| 2,695,220 | 11/1954 | Bergstrom | 165/162 X |
| 3,055,349 | 9/1962 | Hamilton et al. | 122/510 |
| 3,346,043 | 10/1967 | Thurnauer | 165/162 |
| 3,385,271 | 5/1968 | Fleischer | 122/510 |
| 3,951,108 | 4/1976 | Rees | 165/162 |
| 4,520,789 | 6/1985 | Rombouts | 126/91 A |
| 4,796,690 | 1/1989 | Eisinger | 165/162 X |
| 4,878,480 | 11/1989 | Watson et al. | 432/209 X |

FOREIGN PATENT DOCUMENTS

| | | |
|---|---|---|
| 487764 | 6/1938 | United Kingdom . |
| 1396796 | 6/1975 | United Kingdom . |

OTHER PUBLICATIONS

French Search Report, EPO, 5/18/89.

*Primary Examiner*—Larry Jones

*Attorney, Agent, or Firm*—Sandler, Greenblum, & Bernstein

[57] ABSTRACT

A radiating tubes system of the double-pin type that is in the shape of a "W" used in heating ovens, notably in continuous heating ovens for metallic bands, for providing the heat transfer between combustion bases released by a burner and the products to be heated. In the invention system, the burner is positioned in the lower branch of the tubes; the support device of the cold bend, in the upper portion of the tubes, is made in the form of a simple bearing base; the cold bend and the hot bend are connected to one another without a connecting-rod type intermediate part, and the intermediate bend and the lower tube are connected to one another with a settable play between these two elements.

13 Claims, 2 Drawing Sheets

FIG. 1
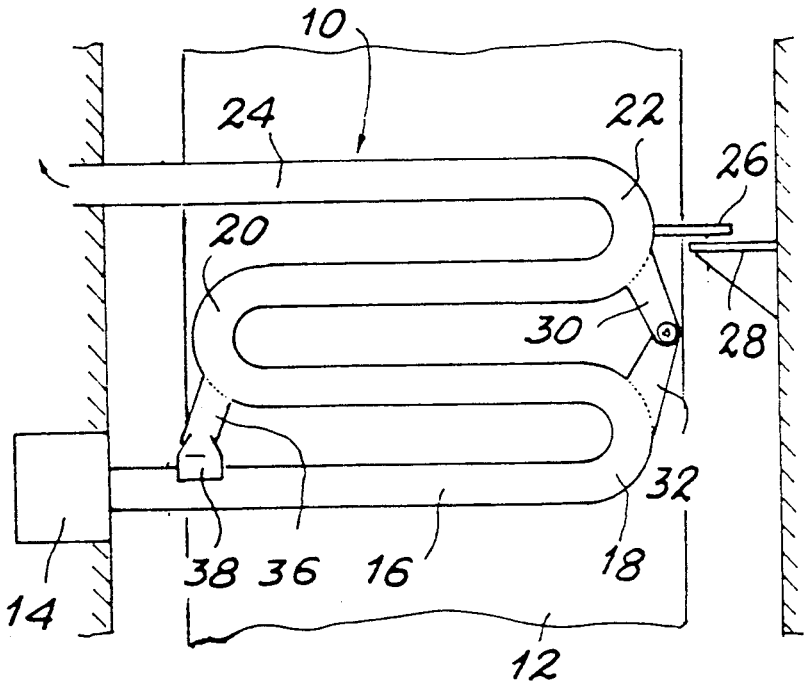
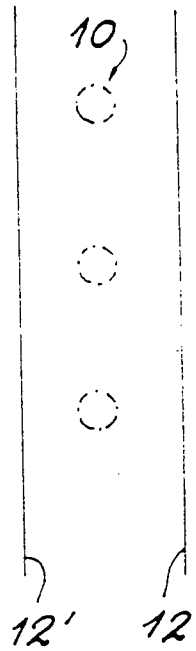
FIG. 2
FIG. 3
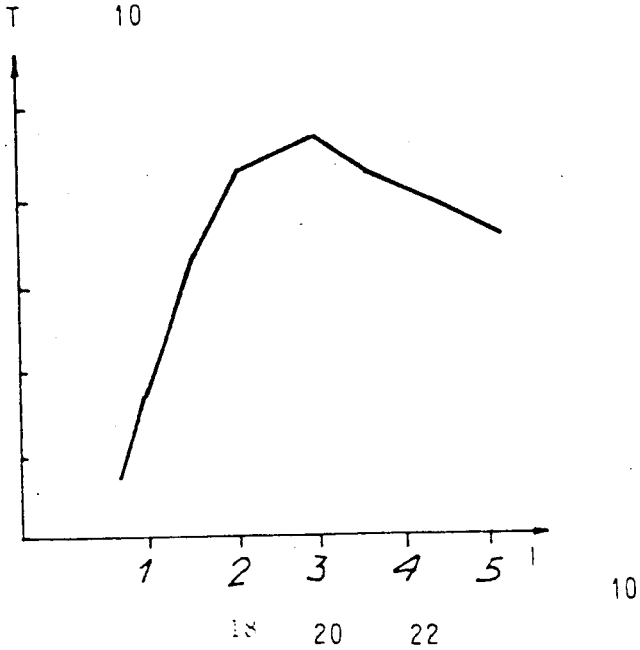
FIG. 4
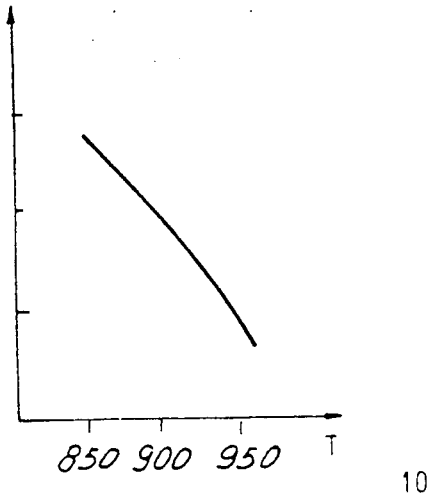

RADIATING TUBES SYSTEM FOR HEATING OVENS

BACKGROUND OF THE INVENTION

1. Field of the Invention

The object of the present invention is to bring about improvements to radiating tubes systems used notably in heating ovens for metallic product bands fed continuously.

2. Description of Background and Relevant Materials

It is known that there is used generally in such heating installations use radiating tubes having a W configuration, also called double-pin tubes. These tubes providing for heat transfer between the combustion gases released by a burner and the product to be heated, notably a metallic band which is fed continuously. Heat transfer is effected by radiation between the radiating tubes system and the product to be heated and by convection/radiation inside the radiating tubes. The combustion gases at the outlet of the radiating tubes system have a temperature which is close to 1000° C. while the temperature of the radiating tubes is an average of 950° C. with a local maximum on the order of 1050° C.

Summary of the Invention

Applicants have has carried out a thorough study of the deformations caused by heat expansions as well as of the stress network associated with these expansions, said stresses appearing when the heating of the tubes is started and during operation when running in a stabilized way or not. The object of the study was to find out means for optimizing the distribution of the stresses while taking into account the creep strength of the materials forming the radiating tubes system; this creeping strength varies strongly as a function of the temperature. The present invention relates to a radiating tubes system which has been improved by taking into account the results of the aforementioned study.

Consequently, the invention relates to radiating tubes systems of the double-pin also known as W-shaped type used in heating ovens, notably in heating ovens for metallic bands fed continuously, for providing heat transfer between the combustion gases released by a burner and the products to be heated, characterized in that:

- the burner is positioned in the lower branch of the tubes;
- the support device of the cold bend, in the upper portion of the tubes, is made in the form of a simple bearing base;
- the cold bend and the hot bend are connected to one another without intermediate part of the connecting-rod type, and
- the intermediate bend and the lower tube are connected to one another with a settable play between these two elements.

According to a feature of this invention, the simple bearing base supporting the cold bend is made in the shape of a bracket which bears the cold bend, prior to the heating of the radiating tubes. The cold bend lifts itself thereby leaving this support as soon as the heating has begun.

According to another feature of this invention, the cold bend and the hot bend are connected via irons on the bends'respective corners. The irons are cast integrally with their respective bend, these corner irons being connected to one another by means of a key or similar device.

According to the invention, the means providing the connection on the burner side between the intermediate bend and the lower tube is formed of a lug, cast integrally with this intermediate bend, and on which is welded a stirrup-shaped part which can come to bear on the lower tube, an intermediate play being provided between the stirrup and the lower tube. The distribution of the stresses of the radiating tube is a function of the value of this intermediate play, the taking over of the effort generated by the intermediate bend being ensured by the lower tube in the portion of the latter which is the coldest.

Other features and advantages of the present invention will become more apparent in the hereafter description, with reference to the accompanying drawing. The drawings illustrating an embodiment of the invention have no limiting character.

BRIEF DESCRIPTION OF THE DRAWINGS

In the drawings:

FIG. 1 is a side elevation view showing partly a continuous band heat treatment oven provided with a system of radiating tubes improved according to the invention;

FIG. 2 is a vertical sectional view of FIG. 1;

FIG. 3 shows the distribution curve of the radiating tubes temperatures over the length of these tubes;

FIG. 4 shows a variation of the creep strength, that is the stress causing the same deformation of the radiating tube as a function of its temperature;

Detailed Description of the Invention

Figure 5:
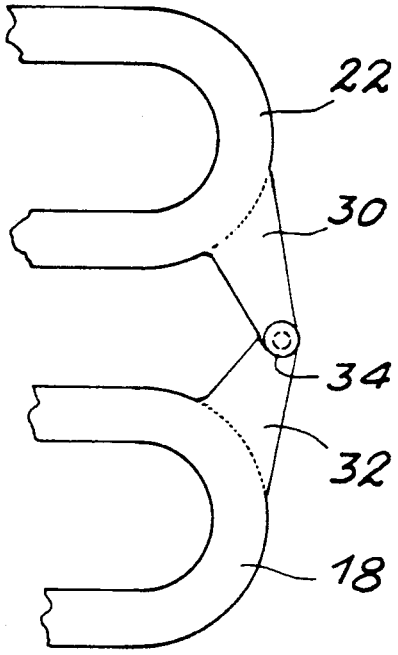
FIG. 5 is a detail of the connection between the cold bend and the hot bend of the radiating tubes system according to the invention.

With reference to the drawings, one sees that the heating oven is used for the heat treatment of bands, notably metallic bands 12, and 12'moving continuously through the oven (continuous feed treatment). Heating is done with the assistance of radiating tubes, the system of which has been designated by reference 10 has a W-shaped or double-pin configuration that is in the shape of a "W". A heater 14 is placed outside the oven enclosure. The combustion gases released by this burner flow through the radiating tubes system 10 before being discharged into the atmosphere. The radiating tubes provide therefore for heat transfer between the combustion gases released by burner 14 and the product 12 and 12' to be heated.

According to the invention, burner 14 is positioned on the lower branch of the radiating tubes system, viz. at the end of the lower tube 16 forming the hot tube. Hot bend 18 extending from hot tube 16 forms the hot bend of system 10. Bend 20 will be called hereafter the intermediate bend, and the upper bend 22 will be called the cold bend, said bend opening into the upper tube 24 forming the cold tube of the radiating tubes system 10.

At the upper portion of system 10, the cold bend 22 is provided with a means for supporting, such as a support device, the function of which is that of a simple bearing base. In this embodiment, this simple bearing base is made in the form of a bracket 28 on which rests a bearing plate 26 which rigidly connected by appropriate means to cold bend 22. When heating of the radiating tubes system 10 is started by starting burner 14, cold tube 24 as well as cold bend 22 lift themselves and the bearing base made of the plate 26 and bracket 28 does not play any role any more in the distribution of the stresses in the tube system 10. The design of this bearing base according to the present invention should not, therefore, place any limitation for the vertical or horizontal expansions.

One will understand that the bend associated with the bearing base is the cold bend 22 in which the highest stresses are acceptable. FIG. 3 shows the temperature variations of the tubes system 10 as a function of its length, and in abscissa is plotted the position of the respective bends 18, 20, 22. FIG. 4 shows the variations of the admissible creep strength as a function of the temperature of the tubes system 10. This curve shows clearly that the admissible stresses in the region of the cold bend 22 are much higher than those acceptable in the hot bend 18. Such a disposition is fundamental for optimizing the stress network.

Figure 6:
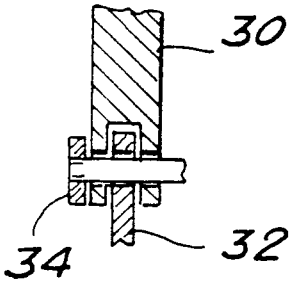
FIG. 6 is a vertical sectional view showing the detail of the connection between the cold and hot bends according to FIG. 5.

According to the invention, there is provided a connection system between the hot bend 18 and the cold bend 22, this connection system is characterized essentially by the fact that it does not include any intermed.iate part (connecting rod). As may be seen in FIGS. 1, 5 and 6, hot bend 18 is provided with a corner iron 32 cast integrally with this hot bend 18 and likewise cold bend 22 is provided with a similar corner iron 30 also cast integrally with this cold bend 22. Thus, corner iron 30 and 32 are obtained directly when casting the bends 18 and 22, of which they are respectively an integral part. For no reason whatever should these corner irons be fixed by welding to the bends, since such weldings generate stress concentrations and risks of micro-crackings in the locations where the stresses are maximum during operation. As may be seen in FIGS. 5 and 6, corner irons 30 and 32 are connected to each other via connection parts which may be in the shape of a pin or key, such as 34, the design being such that the clearances allow relative movements of the hot 18 and cold 22 bends when heating them, starts during the operation of the oven in a stabilized way, and during transitions (variations of power of the radiating tubes system 10). Thus, the device according to the present invention does not generate any extra stress.

Figure 7:
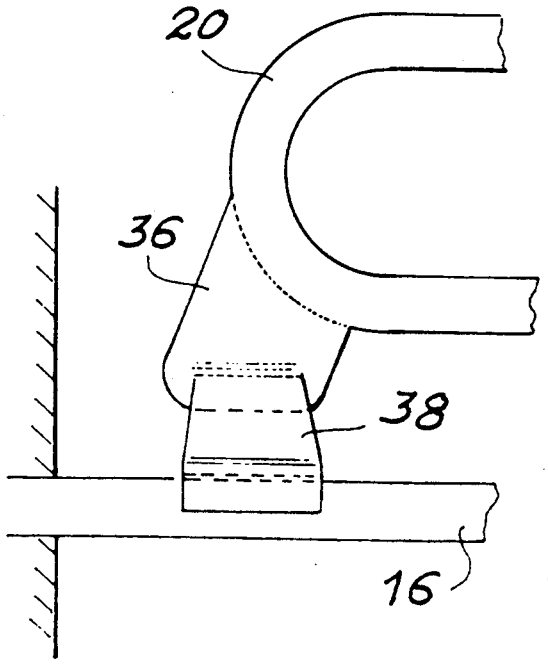
FIG. 7 is detail of the connection between the intermediate bend and the lower hot tube of the radiating tubes system.
Figure 8:
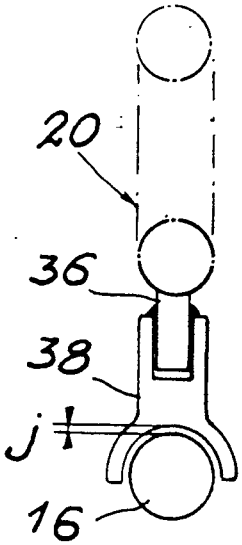
FIG. 8 is a vertical sectional view of FIG. 7.

The improved. radiating tubes system according to the present invention also includes a connection between the intermediate bend 20 and the hot lower bend 18, on the heater 14 side. Such a system, which is shown in FIG. 1 and in more detail in FIGS. 7 and 8, is essential for optimizing the stress distribution of system 10.

As may be seen in the drawing, this connection system includes a part 36 in the shape of a lug, cast integrally with the intermediate bend 20 (any welding between bend 20 and a connection part such as 36 being prohibited for the reasons hereabove-mentioned with respect to corner irons 30 and 32) and a stirrup-shaped part 38 which can be mounted on lug 36 as by welding since this lug does not support any stress.

The connection by welding between lug 36 and stirrup-shaped part 38 is made after a control of the intermediate play "j" between stirrup 38 and the hot lower tube 16. The subsequent stress distribution of the radiating tubes system 10 depends on the value of this intermediate play "j". Indeed, when starting to heat the oven, the intermediate bend 20 moves closer to the lower tube 16 over a distance corresponding to the intermediate play "j" formed in the cold state, and its displacement is therefore limited. This situation corresponds to a cartography of the distribution of the stresses particular to each intermediate play.

One will understand that there is no welded connection between stirrup-shaped part 38 and the hot lower tube 16, this is fundamental since the hot lower tube 16 is subjected to high temperature variations during the operation of burner 14. The taking over of the effort generated by the intermediate bend 20 (limitation of the displacement) is provided by the hot lower tube 16 in the portion where it is the coldest, that is in the portion where it better resists (on the burner side).

According to the present invention, the connection of the lower 16 and upper 24 tubes with the oven metal casing may be provided by any appropriate means and notably by any conventional technique. One will note however that the use of an expansion bellows on one of the branches of the radiating tubes system 10, as is the case in some standard installations, brings about more disadvantages than advantages and under such conditions the invention forms the connection between the lower and upper tubes and the oven metal casing without using any expansion bellows.

Obviously, the present invention is not limited to the embodiment described and shown here and it encompasses all the variants thereof.

What is claimed is:

1. A radiating tubes system of the double-pin type used in heating ovens for metallic bands for providing heat transfer between the combustion gases released by a burner and the products to be heated, comprising:

a burner;

a discharge opening;

a substantially W-shaped tube including a hot lower tube connecting said burn with a hot bend, a cold upper tube connecting said gas discharge opeining with a cold bend, and an intermediate bend is interposed between and connects said hot bend and said cold bend;

means for supporting said cold bend located at an upper portion of said substantially W-shaped tube comprising a simple bearing base;

first connecting means integrally cast with said cold bend and said hot bend for connecting said cold bend and said hot bend to each other without welding; and second connecting means for connecting said intermediate bend and said lower tube to each other and providing a settable play between said intermediate bend and said lower tube.

2. The radiating tubes system according to claim 1, wherein said simple bearing base comprises a bracket upon which said cold bend is capable of bearing prior to heating, and said cold bend being capable of leaving said simple bearing base when heating has begun.

3. The radiating tubes system according to claim 1, wherein said first connecting means comprise corner irons which are integrally cast on said cold bend and said hot bend, and a key connecting said corner irons to each other.

4. The radiating tubes system according to claim 1, wherein said second connecting means is located proximate to said burner.

5. The radiating tubes system according to claim 4, wherein said second connecting means comprises a lug which is integrally cast on said intermediate bend, said lug including a stirrup-shaped part that bears on said lower tube, and is capable of providing an intermediate play between said stirrup-shaped part and said lower tube, with distribution of stresses of said substantially W-shaped tube bein a function of the extent of this play, and a taking over of effort generated by said intermediate bend being ensured by said lower tube in a coldest portion of said lower tube.

6. A radiating tubes system of the double-pin type comprising:

a substantially W-shaped tube having a burner at one opening of the tube;

a hot tube connecting said burner to a hot bend;

an intermediate bend connected to said hot bend;

a cold bend connected to said intermediate bend;

a cold upper tube connecting said cold bend to a gas discharging means; and first supporting means comprising a simple bearing base including a bracket upon which said cold bend is capable of bearing prior to heating, and said cold bend being capable of leaving said simple bearing base when heating has begun;

second supporting means integrally cast with said hot bend and said cold bend for connecting said cold bend and said hot bend to each other without welding; and third supporting means for providing a settable play between said intermediate bend and said lower tube.

7. The radiating tubes system according to claim 6, wherein said first supporting means includes a bearing plate integrally cast with said cold bend.

8. The radiating tubes system according to claim 6, wherein said second supporting means comprise:

a first corner iron integrally cast with said hot bend;

a second corner iron integrally cast with said cold bend; and a key connecting said first corner iron and said second corner iron to each other.

9. The radiating tube system of claim 6, wherein said third supporting means comprise:

a lug cast integrally with said intermediate bend; and a stirrup-shaped part mounted on said lug, said stirrup-shaped part capable of slidable movement on said hot lower tube.

10. An apparatus for optimizing the distribution of stresses in a W-shaped radiating tube system comprising:

means for movably supporting a cold upper bend;

means for connecting said cold upper bend with a hot lower bend which allows relative movement between said upper bend and said lower bend, said means for connecting being integrally cast with said cold upper bend and said hot lower bend; and means for limiting displacement of an intermediate bend integrally cast on the W-shaped radiating tube system.

11. The apparatus for optimizing the distribution of stresses according to claim 10, wherein the means for movably supporting a cold upper bend comprises:

a simple bearing base in the form of a bracket on which rests a bearing plate, said bearing plate being rigidly connected to said cold bend.

12. The apparatus for optimizing the distribution of stresses according to claim 10, wherein said means for connecting said cold upper bend with said hot lower bend comprise:

a first corner iron integrally cast with said hot bend;

a second corner iron integrally cast with said cold bend; and means connecting said first corner iron and said second corner iron to each other for permitting movement of the bends.

13. The apparatus for optimizing the distribution of stresses according to claim 10, wherein the means for limiting displacement of said intermediate bend comprise:

a lug integrally cast with said intermediate bend; and a stirrup-shaped part mounted on said lug, said stirrup-shaped part capable of slidable movement on a hot lower tube.

* * * * *